US012559850B2

(12) United States Patent
Calderara et al.

(10) Patent No.: US 12,559,850 B2
(45) Date of Patent: Feb. 24, 2026

(54) ELECTRODE FOR ELECTROCHEMICAL EVOLUTION OF HYDROGEN

(71) Applicant: INDUSTRIE DE NORA S.P.A., Milan (IT)

(72) Inventors: Alice Calderara, Milan (IT); Stefania Mora, Milan (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 499 days.

(21) Appl. No.: 18/000,369

(22) PCT Filed: Jun. 22, 2021

(86) PCT No.: PCT/EP2021/066952

§ 371 (c)(1),
(2) Date: Nov. 30, 2022

(87) PCT Pub. No.: WO2021/259914

PCT Pub. Date: Dec. 30, 2021

(65) Prior Publication Data

US 2023/0203683 A1 Jun. 29, 2023

(30) Foreign Application Priority Data

Jun. 25, 2020 (IT) ..... 102020000015250

(51) Int. Cl.

| | |
|---|---|
| ***C25B 11/097*** | (2021.01) |
| ***C23C 18/08*** | (2006.01) |
| ***C25B 9/19*** | (2021.01) |
| ***C25B 9/70*** | (2021.01) |
| ***C25B 11/053*** | (2021.01) |
| *C25B 1/04* | (2021.01) |
| *C25B 1/46* | (2006.01) |

(52) U.S. Cl.

CPC ..... *C25B 11/097* (2021.01); *C23C 18/08* (2013.01); *C25B 9/19* (2021.01); *C25B 9/70* (2021.01); *C25B 11/053* (2021.01); *C25B 1/04* (2013.01); *C25B 1/46* (2013.01)

(58) Field of Classification Search

None

See application file for complete search history.

(56) References Cited

U.S. PATENT DOCUMENTS

| | | | | |
|---|---|---|---|---|
| 3,990,957 | A * | 11/1976 | Hoekje | C25B 1/46 204/291 |
| 4,108,745 | A * | 8/1978 | Cipris | C25B 11/091 204/290.14 |
| 4,300,992 | A | 11/1981 | Yoshida et al. | |
| 4,975,161 | A | 12/1990 | Nidola et al. | |
| 2007/0221496 | A1* | 9/2007 | Bohnke | C02F 1/46109 204/242 |
| 2012/0199473 | A1* | 8/2012 | Antozzi | C23C 18/08 204/290.14 |
| 2014/0008215 | A1 | 1/2014 | Brichese et al. | |
| 2015/0308004 | A1* | 10/2015 | Brichese | C25B 11/073 204/252 |

FOREIGN PATENT DOCUMENTS

| | | |
|---|---|---|
| CN | 2253682 Y | 5/1997 |

OTHER PUBLICATIONS

International Search Report and Written Opinion for Corresponding International Application No. PCT/EP2021/066952 (Jul. 26, 2021) (15 Pages).

* cited by examiner

*Primary Examiner* — Luan V Van

(74) *Attorney, Agent, or Firm* — LUCAS & MERCANTI, LLP

(57) ABSTRACT

An electrode suitable for use as a cathode for the development of hydrogen in industrial electrolytic processes, equipped with a catalytic coating having an external layer containing ruthenium and selenium; and a method for the production of the same.

10 Claims, No Drawings

ELECTRODE FOR ELECTROCHEMICAL EVOLUTION OF HYDROGEN

This application is a U.S. national stage of PCT/EP2021/066952 filed on Jun. 22, 2021 which claims the benefit of priority from Italian Patent Application No. 102020000015250 filed Jun. 25, 2020 the contents of each of which are incorporated herein by reference.

FIELD OF THE INVENTION

The present invention relates to an electrode and in particular to an electrode suitable for use as a cathode for the development of hydrogen in industrial electrolytic processes and to a method for its preparation.

BACKGROUND OF THE INVENTION

In the electrolytic process industry, such as the electrolysis of alkaline brines for the simultaneous production of chlorine and alkali and the processes of water electrolysis for the production of hydrogen and oxygen, competitiveness is linked to several factors, the main of which is the reduction in energy consumption, directly linked to the current voltage of the overall process.

The reduction of the aforementioned current voltage can be achieved by using anodes and cathodes with catalytic coatings designed to facilitate the required electrochemical processes, as in the case of the evolution of hydrogen, chlorine or oxygen.

In the membrane process of electrolysis of alkaline brines, for example, the global electrical voltage depends on factors associated with the ohmic drop and mass transport, the resistance of the ion exchange membrane and the electrolyte and the anodic and cathodic overvoltages respectively related to the reactions of gaseous evolution of chlorine and hydrogen.

The cathodic overvoltages obtainable with electrodes of chemically resistant materials, but lacking a good catalytic activity, such as in the case of carbon, have been considered acceptable for a long time.

However, in the specific case, today's market demand is focused on obtaining caustic product with increasingly higher concentrations, this makes the use of carbon steel cathodes impractical due to the obvious corrosion problems, furthermore in the perspective to reducing the energy consumption and the consequent costs, attention was focused on the study of catalytic coatings capable of increasingly reducing the overvoltage of the hydrogen evolution reaction.

The use of activated electrodes with a catalytic coating capable of reducing the cathodic overvoltage of hydrogen has therefore become widespread; good results have been obtained through the use of metal substrates such as, for example, nickel, copper or the steel itself, provided with catalytic coatings based on ruthenium or platinum oxides.

The use of activated electrodes with similar catalytic coatings has led to energy savings such as to be able to compensate the costs deriving from the use of catalysts based on noble metals.

A further fundamental factor influencing the economic convenience of using electrodes activated with catalytic coatings based on noble metals, concerns the electrodes' operating life at high current densities.

However, most of the catalytic coatings based on noble metals tend to suffer serious damages as a result of current reversals that can occur in the event of inefficiencies on industrial plants; the switch to anodic current with consequent raising of the electrode potential to high values, can cause the uncontrolled dissolution of platinum or ruthenium oxide.

A partial resolution to this problem has been obtained by adding, to the formulation of the catalytic coating, elements of the rare earth group. The cathodes having these coatings prove to be sufficiently resistant in the normal operating conditions of the plant.

A further improvement of the resistance to current reversals has been obtained by applying to the metal substrate a catalytic coating consisting of distinct phases including platinum, rhodium and/or palladium. However, this type of coating requires high loads of platinum and rhodium in the catalytic phase, such as to determine a rather high production cost.

Therefore, it is evident the need for a new cathode composition for industrial electrolytic processes, in particular for electrolytic processes with cathodic hydrogen evolution, characterized, as compared to prior art formulations, by an improved catalytic activity at high current densities, with a total cost equal or lower, in terms of raw materials, and with a duration and resistance to accidental current inversions equal to or greater than the usual operating conditions.

U.S. Pat. No. 4,300,992 A describes an electrode for hydrogen gas evolution in electrolytic processes comprising a metal substrate provided with a catalytic coating comprising an internal layer containing ruthenium and an external selenium layer. U.S. Pat. No. 4,975,161 A describes an electrode for hydrogen gas evolution having a single catalytic coating comprising ruthenium and selenium. US 2014/008215 A1 describes an electrode for hydrogen gas evolution comprising a metal substrate provided with a catalytic coating made from a platinum layer followed by a layer containing ruthenium and praseodymium. U.S. Pat. No. 3,990,957 A describes an electrode for hydrogen gas evolution comprising a metal substrate provided with a catalytic coating which comprises ruthenium and strontium.

The present invention has the purpose of solving the problems described above and relates to a cathode characterized by low hydrogen overvoltage and excellent resistance to current reversals when the electrolysis is interrupted. The invention also relates to a method for producing the same and an electrolyser that contains it.

SUMMARY OF THE INVENTION

In the industry of electrolytic processes, the main driver for competitiveness is sought in the reduction of electrical voltage. The cathode coating represents a significant element to achieve such a reduction of electrical voltage, however all the changes that lead to an improvement in electrical voltage frequently result in a weaker coating to the current inversions that can occur accidentally in the events of malfunction on the industrial plants.

The electrode equipped with the catalytic coating, as described in the present invention, solves the aforementioned problem by providing an improved cell voltage with respect to the state of the art and maintaining an optimal robustness, in terms of resistance to reversals.

Under a first aspect, the present invention relates to an electrode for gas evolution in electrochemical processes comprising a metal substrate provided with a catalytic coating, said catalytic coating comprising an internal layer containing at least one element selected from the group of noble metals, in the form of metals or their oxides, and optionally one or more elements selected from the group of rare earths and/or an element selected from the group of alkaline earth metals, in the form of metals or their oxides, and an external layer comprising 80-99.5% by weight of ruthenium and 0.5-20% by weight of selenium referred to the metal elements, in the form of metals or their oxides.

The use of selenium allows to considerably reduce the hydrogen cathodic overvoltage and to reach a stable cell voltage value in a short time, comparable to that obtained through the use of catalytic compositions with much higher quantities of noble metals. The use of ruthenium in the external layer improves resistance of the coating to current reversals. Compositions as the one described in the present invention allow further to obtain an excellent robustness of the cathode coating to shutdown events, equal to the best obtained with high quantities of ruthenium stabilized due to the presence of rare earths in the catalytic coating.

According to the present invention, the metal substrate can be any metal suitable for use as electrodic support for electrochemical processes. In particular as metal substrate for a cathode to be used in chlor-alkali electrolysis and water electrolysis processes. In this case, the most used metal substrates can be chosen from nickel, nickel alloys, copper and steel.

According to an embodiment of the electrode according to the present invention, wherein said at least one element selected from the group of noble metals of said internal layer is platinum and/or ruthenium.

According to an embodiment of the electrode according to the present invention, said internal layer of said catalytic coating comprises 60-100% by weight of ruthenium and 0-40% by weight of a metal selected from the group of rare earths.

The presence of one or more elements belonging to the rare earth group has the purpose of stabilizing the matrix of noble metal, making it more resistant to current inversions that can occur in the electrolyzers during uncontrolled stopping events.

According to an embodiment of the electrode according to the present invention, said external layer of said catalytic coating comprises 90-99.5% by weight of ruthenium and 0.5-10% by weight of selenium referred to metals.

The inventors have surprisingly observed that the addition of selenium, even in small quantities, to catalytic coatings comprising mainly ruthenium, allows to obtain unexpectedly improved performances in terms of catalytic activity for the hydrogen evolution reaction.

In a further embodiment, said external layer of said catalytic coating has a composition by weight referred to the metals comprising 95-99.5% of ruthenium and 0.5-5% of selenium.

In yet another embodiment, said external layer of said catalytic coating has a composition by weight referred to the metals comprising 90-99% of ruthenium and 1-10% of selenium.

Selenium constitutes the active component responsible for improving the overvoltage of the hydrogen evolution reaction, allowing an evident improvement in the catalytic activity even when present at low concentrations.

Furthermore, the presence of selenium in the matrix composed mainly of ruthenium, in combination with the presence of a metal chosen among the rare earth group, has the advantage of increasing the operating life time of the electrode allowing a reduced consumption of the catalytic coating, expressed in percentage quantity of noble metal consumed.

According to a further embodiment, the invention relates to an electrode wherein the internal layer contains one or more elements selected from the group of rare earths and wherein the metal selected from the rare earth group is praseodymium, cerium and/or lanthanum.

The experimentation conducted by the inventors has shown that praseodymium provides better results than the other elements belonging to the rare earth group, but the invention can also be successfully practiced with cerium and/or lanthanum.

In one embodiment, said internal layer of said catalytic coating has a weight composition referred to the metals comprising 60-90% ruthenium and 10-40% praseodymium and said external layer has a weight composition referred to the metals comprising 80-99.5% ruthenium and 0.5-20% selenium.

The inventors have found that the indicated compositions by weight are able of imparting a high catalytic activity combined with an excellent resistance to current reversals.

Under a further embodiment, said internal layer of said catalytic coating comprises ruthenium and at least one other element selected from the group of alkaline earth metals, in particular chosen from strontium, calcium and barium. The experimentation conducted by the inventors has shown that formulations of this type provide a further improvement to the hydrogen overvoltage, also allowing the achievement of the cell performance at steady state in an improved time compared to that generally observed with other formulations.

In one embodiment, said internal layer of said catalytic coating has a composition by weight referred to metals comprising 90-99% of ruthenium and 1-10% of a metal selected among the group of alkaline earth metals and said external layer has a composition by weight referred to metals comprising 80-99.5% of ruthenium and 0.5-20% of selenium.

In one embodiment, said catalytic coating further comprises a further layer in direct contact with the metal substrate comprising platinum and/or palladium in the form of metals or their oxides. This can lead to an additional improvement to the electrode's resistance to current inversions, making it surprisingly similar or even better than those that characterize the electrodes activated with high amounts of platinum only.

It is to be understood that the elements present in the catalytic coating can be in the form of metal or in the form of oxides.

In a further embodiment, the catalytic coating has a specific load of ruthenium between 4 and 15 $g/m^2$. The inventors have found that, in the case of the indicated catalytic coating, reduced ruthenium loads are more than sufficient to impart a good resistance to current inversions combined with an excellent catalytic activity not found in the prior art of ruthenium-based catalytic coatings.

In a further embodiment of the electrode according to the invention, the preferred metal substrate is nickel or nickel alloy.

Under a further aspect, the present invention relates to a method for the preparation of an electrode for the evolution of gaseous products in electrolytic cells, for example for hydrogen evolution in alkaline brine electrolysis or water electrolysis cells, comprising the following stages:

a) application to a metal substrate of a solution containing the precursors of the components of said internal layer;
b) optional drying at 30-100° C. for a time of 5 to 60 minutes;
c) decomposition of said solution containing the precursors of the components of said internal layer by thermal treatment at 400-600° C.;

d) optional repetition of steps a-c or one or more times until the desired load is reached;

e) application of a solution containing the precursors of the components of said external layer;

f) optional drying at 30-100° C. for a time of 5 to 60 minutes;

g) decomposition of said solution containing the precursors of the components of said external layer by thermal treatment at 400-600° C.;

h) optional repetition of stages e-g one or more times until the desired load is reached.

In one embodiment, said solution containing the precursors of the components of said internal layer, contains precursors of ruthenium and of an element selected from the rare earth group and said solution containing the precursors of the components of said external layer, contains the precursors of ruthenium and selenium.

In a further embodiment, said solution containing the precursors of the components of said internal layer, contains precursors of ruthenium and praseodymium and said solution containing the precursors of the components of said external layer, it contains the precursors of ruthenium and selenium.

In one embodiment, said solution containing the precursors of the components of said internal layer, contains precursors of ruthenium and of an element selected from the group of alkaline earth metals and said solution containing the precursors of the components of said external layer, contains the precursors of ruthenium and selenium.

According to an embodiment of the above method, said method comprises further steps prior to step (a), comprising the application in direct contact with a metal substrate of a solution containing platinum, optional drying at 30-100° C. for a time comprised of 5 to 60 minutes and decomposition of said solution containing platinum by heat treatment at 400-600° C.

In a further aspect, the invention relates to a cell for the electrolysis of alkaline chloride solutions comprising an anodic compartment and a cathodic compartment, separated by a ion exchange membrane or a diaphragm where the cathodic compartment is equipped with an electrode in one of the forms described above used as a cathode for hydrogen evolution. Under a further aspect, the invention relates to an electrolyser for the production of chlorine and alkali starting from alkaline brine comprising a modular arrangement of electrolytic cells with the anodic and cathodic compartments separated by ion exchange membranes or diaphragms, where the cathodic compartment comprises an electrode in one of the forms as described above used as a cathode.

Under a further aspect, the invention relates to an electrolyzer for the production of hydrogen by electrolysis of water comprising an anodic compartment and a cathodic compartment separated by a diaphragm where the cathode compartment is equipped with an electrode in one of the forms as described above.

The following examples are included to demonstrate particular embodiments of the invention, the practicability of which has been extensively tested within the claimed range of values. It will remain evident to those skilled in the art that the compositions and techniques described in the following examples represent compositions and techniques which the inventors have found to work well in the practice of the invention; however, the person skilled in the art will also appreciate that in the light of the present description, various changes can be made to the various embodiments described still giving rise to identical or similar results without departing from the scope of the invention.

EXAMPLE 1

A nickel mesh having dimensions of 100 mm×100 mm×0.89 $mm^2$ was subjected to a process of sandblasting with corundum, pickling in HCl and stress relieving by heat treatment according to the procedure known in the art.

A solution containing a precursor of ruthenium and strontium having a composition expressed as a percentage by weight equal to 95% Ru and 5% Sr was prepared.

A second solution containing precursors of ruthenium and selenium having a composition expressed as a percentage by weight equal to 92% Ru and 8% Se was prepared.

The first solution was applied to the nickel mesh by brushing in 6 coats.

After each coat, drying was carried out at 40-60° C. for about 10 minutes, then a heat treatment of 10 minutes at 500° C. The mesh was air-cooled each time before applying the next coat.

The procedure was repeated until a total Ru load of 8 $g/m^2$ was reached.

Subsequently, the second solution was applied by brushing in 6 coats. After each coat drying was carried out at 40-60° C. for about 10 minutes, then a heat treatment of 10 minutes at 500° C. The mesh was air-cooled each time before applying the next coat.

The procedure was repeated until a total Ru load of 15 $g/m^2$ was reached.

The electrode thus obtained was identified as sample E1.

EXAMPLE 2

A nickel mesh having dimensions of 100 mm×100 mm×0.89 mm2 was subjected to a process of sandblasting with corundum, pickling in HCl and stress relieving by heat treatment according to the procedure known in the art.

A solution containing a precursor of ruthenium and praseodymium having a composition expressed as a percentage by weight equal to 83% Ru and 17% Pr was prepared.

A second solution containing precursors of ruthenium and selenium having a composition expressed as a percentage by weight equal to 95% Ru and 5% Se was prepared.

The first solution was applied to the nickel mesh by brushing in 5 coats.

After each coat drying was carried out at 40-60° C. for about 10 minutes, then a heat treatment of 10 minutes at 500° C. The mesh was air-cooled each time before applying the next coat.

The procedure was repeated until a total Ru load of 5 $g/m^2$ was reached.

Subsequently, the second solution was applied by brushing in 6 coats. After each coat drying was carried out at 40-60° C. for about 10 minutes, then a heat treatment of 10 minutes at 500° C. The mesh was air-cooled each time before applying the next coat.

The procedure was repeated until a total Ru load of 11 $g/m^2$ was reached.

The electrode thus obtained was identified as sample E2.

EXAMPLE 3

A nickel mesh having dimensions of 100 mm×100 mm×0.89 mm2 was subjected to a process of sandblasting with corundum, pickling in HCl and stress relieving by heat treatment according to the procedure known in the art.

A solution containing a precursor of ruthenium and praseodymium having a composition expressed as a percentage by weight equal to 84% Ru and 16% Pr was prepared.

A second solution containing precursors of ruthenium and selenium having a composition expressed as a percentage by weight equal to 98.5% Ru and 1.5% Se was prepared.

The first solution was applied to the nickel mesh by brushing in 5 coats.

After each coat, drying was carried out at 40-60° C. for about 10 minutes, then a heat treatment of 10 minutes at 500° C. The mesh was air-cooled each time before applying the next coat.

The procedure was repeated until a Ru load of 5 g/m$^2$ was reached.

Subsequently, the second solution was applied by brushing in 5 coats. After each coat drying was carried out at 40-60° C. for about 10 minutes, then a heat treatment of 10 minutes at 500° C. The mesh was air-cooled each time before applying the next coat.

The procedure was repeated until a total Ru load of 10.5 g/m$^2$ was reached.

The electrode thus obtained was identified as sample E3.

COUNTEREXAMPLE 1

A nickel mesh having dimensions of 100 mm×100 mm×0.89 mm$^2$ was subjected to a process of sandblasting with corundum, pickling in HCl and stress relieving by heat treatment according to the procedure known in the art.

100 ml of a solution containing precursors of ruthenium and praseodymium having a composition expressed as a percentage by weight equal to 83% Ru and 17% Pr were prepared.

The solution was then applied to the nickel mesh by brushing in 8 coats.

After each coat drying was carried out at 40-60° C. for about 10 minutes, then a heat treatment of 10 minutes at 500° C. The mesh was air-cooled each time before applying the next coat.

The procedure was repeated until a total Ru load of 11 g/m$^2$ was reached.

The electrode thus obtained was identified as CE1 sample.

COUNTEREXAMPLE 2

A nickel mesh having dimensions of 100 mm×100 mm×0.89 mm$^2$ was subjected to a process of sandblasting with corundum, pickling in HCl and stress relieving by heat treatment according to the procedure known in the art.

100 ml of a solution containing precursors of ruthenium and strontium having a composition expressed in percentage by weight equal to 97% Ru and 3% Sr were prepared.

The solution was then applied to the nickel mesh by brushing in 6 coats.

After each coat drying was carried out at 40-60° C. for about 10 minutes, then a heat treatment of 10 minutes at 500° C. The mesh was air-cooled each time before applying the next coat.

The procedure was repeated until a total Ru load of 11 g/m$^2$ was reached.

The electrode thus obtained was identified as CE2 sample

The samples of the examples described above were subjected to performances tests, under hydrogen evolution, in a laboratory cell fed with 32% NaOH at a temperature of 90° C., moreover some samples were subsequently subjected to cyclic voltammetry tests in the potential range from −1 to +0.5 V/NHE with a scan speed of 10 mV/s.

Table 1 reports the initial cathodic potential, corrected for the ohmic drop value, measured at a current density of 9 kA/m$^2$.

TABLE 1

| Samples | mV vs NHE |
|---|---|
| E1 | 932 |
| E2 | 934 |
| E3 | 937 |
| CE1 | 952 |
| CE2 | 942 |

Table 2 reports the initial cathodic potential and the cathodic potential after 10 and 25 cycles of cyclic voltammetry (10 CV, 25 CV), index of resistance to inversions, measured at a current density of 6 kA/m$^2$.

TABLE 2

| Samples | mV vs NHE | mV vs NHE (10 CV) | mV vs NHE (25 CV) |
|---|---|---|---|
| E1 | 924 | 1100 | 1141 |
| E2 | 924 | 1040 | 1094 |
| E3 | 927 | 1027 | 1103 |
| CE1 | 941 | 1052 | 1093 |
| CE2 | 933 | 1112 | 1148 |

Table 3 shows the time to reach cell performance at steady state and the specific consumption of the electrode, expressed as a percentage of residual noble metal and a further index of resistance to current inversions. Data were obtained using a laboratory membrane cell having an active cathodic area equal to 0.2 dm$^2$ at 8 kA/m$^2$ after 8000 hours of activity (HOL). The test was carried out with NaCl 210 g/l anolyte, 32% by weight NaOH catholyte, at T=89° C.

TABLE 3

| Samples | % Residual nobel metal load | Time to reach steady state |
|---|---|---|
| E1 | 65 | <3 days |
| E2 | 75 | <3 days |
| E3 | 75 | <4 days |
| CE1 | 75 | <7 days |
| CE2 | 65 | <5 days |

The previous description is not intended to limit the invention, which can be used according to different embodiments without departing from the purposes for this and whose scope is univocally defined by the attached claims.

In the description and the claims of the present application, the term "comprises" and "contains" and their variants as "comprising" and "containing" do not intend to exclude the presence of other additional elements, components or process steps.

The discussion of documents, documents, materials, apparatuses, articles and the like is included in the text for the sole purpose of providing a context to the present invention; however, it is not to be understood that this matter or part of it constituted general knowledge in the field relating to the invention before the priority date of each of the claims attached to this application.

The invention claimed is:

1. An electrode configured as a cathode for hydrogen gas evolution in electrolytic processes comprising a metal substrate provided with a catalytic coating, said catalytic coating comprising an internal layer directly on the metal substrate, said internal layer containing at least one element selected from the group of noble metals, in the form of metals or their oxides, and optionally one or more elements selected from the group of rare earths and/or an element selected from the group of alkaline earth metals, in the form of metals or their oxides, and an external layer comprising 80-99.5% by weight of ruthenium and 0.5-20% by weight of selenium referred to the metal elements, in the form of metals or their oxides, wherein the external layer is free of platinum-group metals other than ruthenium.

2. The electrode according to claim 1, wherein said at least one element selected from the group of noble metals of said internal layer is platinum and/or ruthenium.

3. The electrode according to claim 1, wherein said external layer comprises 90-99% by weight of ruthenium and 1-10% by weight of selenium referred to the metal elements.

4. The electrode according to claim 1, wherein said internal layer contains one or more elements selected from the group of rare earths, wherein said one or more elements selected from the group of rare earths of said internal layer are praseodymium, cerium and/or lanthanum.

5. The electrode according to claim 1, wherein said internal layer contains ruthenium and an element selected from the group of alkaline earth metals.

6. The electrode according to claim 1, wherein said catalytic coating comprises a further layer in direct contact with the metal substrate comprising platinum and/or palladium in the form of metals or their oxides.

7. The method for the preparation of an electrode as defined in claim 1, comprising the following steps:

a. applying, to a metal substrate, a solution containing precursors of components of said internal layer, wherein the components are at least one element selected from the group of noble metals, and optionally one or more elements selected from the group of rare earths and/or an element selected from the group of alkaline earth metals;

b. optionally drying at 30-100° C. for a time of 5 to 60 minutes;

c. decomposing said solution by thermal treatment at 400-600° C.;

d. optionally repeating steps a-c one or more times until the desired load is reached;

e. applying a solution containing precursors of components of said external layer, wherein the components are ruthenium and selenium;

f. optionally drying at 30-100° C. for a time of 5 to 60 minutes;

g. decomposing said solution by thermal treatment at 400-600° C.;

h. optionally repeating stages e-g one or more times until the desired load is reached.

8. A cell for the electrolysis of alkaline chloride solutions comprising an anodic compartment and a cathodic compartment separated by an ion exchange membrane or by a diaphragm where the cathodic compartment is equipped with the electrode according to claim 1.

9. An electrolyzer for the production of chlorine and alkali from alkaline brine, comprising a modular arrangement of cells, wherein each cell is the cell according to claim 8.

10. An electrolyzer for the production of hydrogen by electrolysis of water comprising an anodic compartment and a cathodic compartment separated by a diaphragm wherein the cathodic compartment is equipped with the electrode according to claim 1.

* * * * *